US009365968B2

(12) United States Patent
Ong et al.

(10) Patent No.: US 9,365,968 B2
(45) Date of Patent: Jun. 14, 2016

(54) STEAM IRON WITH A STEAM-PERMEABLE SCREEN

(71) Applicant: KONINKLIJKE PHILIPS N.V., Eindhoven (NL)

(72) Inventors: Chee Keong Ong, Eindhoven (NL); Mohankumar Valiyambath Krishnan, Eindhoven (NL); Rico Paolo Ochoa Ramirez, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/406,908

(22) PCT Filed: May 27, 2013

(86) PCT No.: PCT/IB2013/054366

§ 371 (c)(1),
(2) Date: Dec. 10, 2014

(87) PCT Pub. No.: WO2013/186649

PCT Pub. Date: Dec. 19, 2013

(65) Prior Publication Data

US 2015/0152589 A1 Jun. 4, 2015

(30) Foreign Application Priority Data

Jun. 12, 2012 (EP) ..... 12171568

(51) Int. Cl.

| | |
|---|---|
| ***D06F 75/18*** | (2006.01) |
| ***D06F 75/38*** | (2006.01) |
| ***D06F 75/16*** | (2006.01) |
| ***D06F 75/20*** | (2006.01) |

(52) U.S. Cl.

CPC ..... *D06F 75/18* (2013.01); *D06F 75/16* (2013.01); *D06F 75/20* (2013.01); *D06F 75/38* (2013.01)

(58) Field of Classification Search

CPC ..... D06F 75/00; D06F 75/08; D06F 7/10; D06F 75/14; D06F 75/16; D06F 75/18; D06F 75/24; D06F 75/38; D05B 75/20

See application file for complete search history.

(56) References Cited

U.S. PATENT DOCUMENTS 1,431,419 A * 10/1922 Pollard ..... D06F 75/06 38/77.6
1,958,876 A 5/1934 Wright (Continued)

FOREIGN PATENT DOCUMENTS

DE 724171 C 8/1942
DE 3006783 A1 8/1981

(Continued)

*Primary Examiner* — Ismael Izaguirre

(57) ABSTRACT

A steam iron (1) comprising: a housing (2) defining a water vaporization chamber (22); a heating element (12), accommodated by the housing (2) and configured to heat the vaporization chamber (22); a sole plate (8), connected to the housing and defining at least one steam outlet opening (10); a steam-permeable screen (24), disposed within the water vaporization chamber (22) and dividing the water vaporization chamber into a vaporization zone (28) and a steam zone (30); a liquid water supply channel (16) having an outlet (**16*b*) that discharges into the vaporization zone (28); and a steam discharge channel (20) having a steam inlet (20*a*) that originates from the steam zone (30) and a steam outlet (20*b*) that discharges into the at least one steam outlet opening (10) in the sole plate (8**).

16 Claims, 2 Drawing Sheets

(56) References Cited

U.S. PATENT DOCUMENTS

| | | | | | |
|---|---|---|---|---|---|
| 2,190,904 | A | | 12/1939 | Wiggins | |
| 2,247,438 | A | * | 7/1941 | Gorton | D06F 75/12 38/77.6 |
| 2,294,615 | A | * | 9/1942 | Tullis | D06F 75/02 126/412 |
| 2,368,048 | A | | 1/1945 | Stone | |
| 2,456,490 | A | | 12/1948 | Busch | |
| 2,815,592 | A | | 2/1954 | Gomersall | |
| 4,057,918 | A | | 11/1977 | Zeier | |
| 4,087,263 | A | | 5/1978 | Schonmann, Jr. | |
| 4,091,551 | A | | 5/1978 | Schaeffer | |
| 4,240,217 | A | | 12/1980 | Schwob | |
| 5,090,432 | A | | 2/1992 | Bran | |
| 5,279,054 | A | * | 1/1994 | Chasen | D06F 75/24 219/254 |
| 5,390,432 | A | | 2/1995 | Boulud | |
| 6,684,539 | B2 | * | 2/2004 | Boulud | D06F 75/18 38/77.83 |
| 8,615,909 | B2 | * | 12/2013 | Pang | D06F 75/20 38/77.6 |
| 2005/0183296 | A1 | | 8/2005 | Lesaga | |
| 2012/0039586 | A1 | | 2/2012 | Collinson | |

FOREIGN PATENT DOCUMENTS

| | | | | |
|---|---|---|---|---|
| EP | 0658647 | A1 | | 6/1995 |
| FR | 2979922 | A1 | * | 9/2011 |
| WO | 03062518 | A1 | | 7/2003 |

* cited by examiner

STEAM IRON WITH A STEAM-PERMEABLE SCREEN

This application is the U.S. National Phase application under 35 U.S.C. §371 of International Application No. PCT/IB2013/054366, filed on May 27, 2013, which claims the benefit of European Application No. 12171568.4 filed on Jun. 12, 2012. These applications are hereby incorporated by reference herein.

FIELD OF THE INVENTION

The present invention relates to a steam iron, and more in particular to a steam iron configured to prevent spitting behaviour during operation.

BACKGROUND

A steam iron may typically be equipped with a vaporization chamber having a heatable bottom surface. During operation, the bottom surface may be heated to a temperature well above the boiling point of water, and liquid water may be brought into contact therewith in order to vaporize it and turn it into steam. The steam may then be discharged to steam outlet openings provided in a soleplate of the iron.

A known problem associated with this procedure, especially at low steam rate settings, is the occurrence of the Leidenfrost effect: a water droplet dripped onto the hot bottom surface of the vaporization chamber may produce an insulating vapor layer that prevents it from rapid vaporization. Instead of instantly boiling, the insulated water droplet may skitter around. At relatively high steam rate settings, on the other hand, which may require actual submersion of the bottom surface, the heating of the water result in a violently boiling and splashing water pool inside of the vaporization chamber. In either case, small water droplets splattering around the vaporization chamber may be entrained in the flow of steam leaving it, and eventually be undesirably spit out of the steam outlet openings.

Several solutions have been offered in the art to eliminate the thus caused spitting behavior of steam irons. One solution employs long and often tortuous steam discharge paths, extending between the steam vaporization chamber and the steam outlet openings in the soleplate, to ensure that small water droplets carried by the steam flow are vaporized before they reach the steam outlet openings. Another solution is described in U.S. Pat. No. 5,390,432 (Boulud et al.). U.S. Pat. No. '432 teaches the combined use of (i) a hydrophilic coating on top of the bottom surface of the vaporization chamber to promote the spreading of water over the surface, and (ii) a screen disposed above the coating, preferably in contact therewith, for fragmenting water droplets dripped thereon. This way, the vaporization performance of the iron is enhanced by forced distribution of water across the bottom surface of the vaporization chamber, and entrainment of skittering water droplets in the outgoing steam flow is prevented. Neither solution, however, appears to work satisfactorily for high steam rates at which the risk of entraining water droplets is greatest. The first solution requires impractically long steam discharge paths to ensure the complete vaporization of all entrained water droplets; the second solution is sensitive to unintended submersion of the bottom surface (due to a necessarily high inflow of water into the vaporization chamber), which may cause the screen to lose its water distributing function.

SUMMARY OF THE INVENTION

It is therefore an object of the present invention to provide for a steam iron capable of operating at both low and relatively high steam rates substantially without exhibiting spitting behavior.

To this end, a first aspect of the present invention is directed to a steam iron. The steam iron may include a housing that comprises a water vaporization chamber that is at least partly bounded by a bottom wall, and that accommodates a heating element configured to heat the bottom wall of the vaporization chamber. The steam iron may further include a soleplate connected to the housing and defining at least one steam outlet opening. Within the vaporization chamber, a steam-permeable screen may be disposed such that it at least partially extends over the bottom wall in a spaced apart relationship thereto, and such that it divides the vaporization chamber into a vaporization zone that is at least partially disposed below the steam-permeable screen and a steam zone that is at least partially disposed above the steam-permeable screen. The steam iron may also include a water reservoir, and a liquid water supply channel having a water inlet that is fluidly connected to the water reservoir, and a water outlet that discharges into the vaporization zone. In addition, a steam discharge channel having a steam inlet that originates from the steam zone and a steam outlet that discharges into the at least one steam outlet opening in the soleplate may be provided to transport steam from the vaporization chamber.

In the presently disclosed steam iron, the steam-permeable screen may divide the evaporation chamber into two volumes: the vaporization zone, and the steam zone. The liquid water supply channel may have a water outlet that discharges into the vaporization zone, such that, during operation, liquid water may be introduced directly into the vaporization zone via the water outlet, i.e. without passing contact with the steam-permeable screen. Within the vaporization zone, the liquid water may then be heated through heat from the heating element and thus be vaporized into steam. The vaporization process in the vaporization zone may be violent and splashy, and for instance amount to a boiling pool of water from which water jets erupt in the direction of steam zone. The steam-permeable screen, however, may ensure that only steam passes from the vaporization zone to the steam zone; skittering liquid water droplets and jets may be caught on the steam-permeable screen and thus be prevented from passing through the screen into the steam zone. Accordingly, the steam inlet of the steam discharge channel, originating from the steam zone, may take in a steam flow substantially void of at least macroscopic liquid water droplets, and discharge it towards the steam outlet openings in the soleplate of the iron.

For clarity it is noted that the function of the steam-permeable screen in the presently disclosed steam iron is different from that of the screen disclosed in U.S. Pat. No. '432. While the screen in U.S. Pat. No. '432 serves to mechanically distribute water across the heatable bottom surface of the vaporization chamber, the steam-permeable screen in the iron according to the invention serves to contain splashy boiling water within the vaporization zone of the vaporization chamber. The difference in function is reflected in the different structures of the two screens, and in the ways they are implemented.

The screen of U.S. Pat. No. '432, for instance, is adapted to be permeable to both liquid water (trickling down) and steam (ascending from the heated bottom surface), while the steam-permeable screen of the presently disclosed iron is adapted to be permeable to steam only. This functional difference may translate into different dimensions for the openings in the screen. In one embodiment of the present invention, for instance, the steam-permeable screen may define a mesh having about 2-50 openings per linear centimeter, and more preferably about 5-10 openings per linear centimeter. Such meshes may effectively prevent water droplets impacting on the screen from passing through, while steam may easily pass.

U.S. Pat. No. '432 teaches that the screen preferably extends over the totality of the bottom surface of the vaporization chamber; in addition, the screen is advantageously in direct contact with that bottom surface, although it may be disposed at a slight distance of about 1-2 mm thereabove.—In the presently disclosed iron, the steam-permeable screen need not extend over an entire heated bottom surface of the vaporization chamber, although it may in some embodiments. Moreover, the steam-permeable screen is not disposed in direct contact with any closed surface, such as for example a heated bottom surface, since such contact would block the openings in the screen. Instead, in an embodiment of the steam iron featuring a vaporization chamber with a heated bottom surface, the steam-permeable screen may typically be spaced apart from that bottom surface in order to define a volume, the vaporization zone, between the bottom surface and itself. A height of the vaporization zone, i.e. the spacing between the heated bottom surface of the vaporization chamber and a portion of the screen extending thereabove, may preferably be at least 5 mm, so as to enable the bottom surface to be fully submerged with a shallow pool of water, and to allow for some motion at the surface of the water pool without the bulk of the water touching the screen. Accordingly, the configuration may preferably be such that, during operation, liquid water may contact the steam-permeable screen from the side of the vaporization zone only in the form of droplets, splashes or jets; these can be stopped from passing effectively.

Another difference between the steam iron disclosed in U.S. Pat. No. '432 and that according to the present invention is that the steam iron in U.S. Pat. No. '432 is adapted to introduce liquid water into the vaporization chamber by bringing it into contact with the screen, e.g. by dripping liquid water droplets thereon. The screen then mechanically distributes the water across the heated bottom surface of the vaporization chamber so as to cause the rapid evaporation thereof, and the resulting steam may pass back up through the screen to be discharged from the vaporization chamber, towards the steam outlet openings in the soleplate. In contrast, in the steam iron according to the present invention liquid water is introduced directly into the vaporization zone. During operation, water may thus contactingly pass through the steam-permeable screen only once in the form of steam; in liquid form, it should ideally never contactingly pass the steam-permeable screen.

These and other features and advantages of the invention will be more fully understood from the following detailed description of certain embodiments of the invention, taken together with the accompanying drawings, which are meant to illustrate and not to limit the invention.

DETAILED DESCRIPTION

Figure 1:
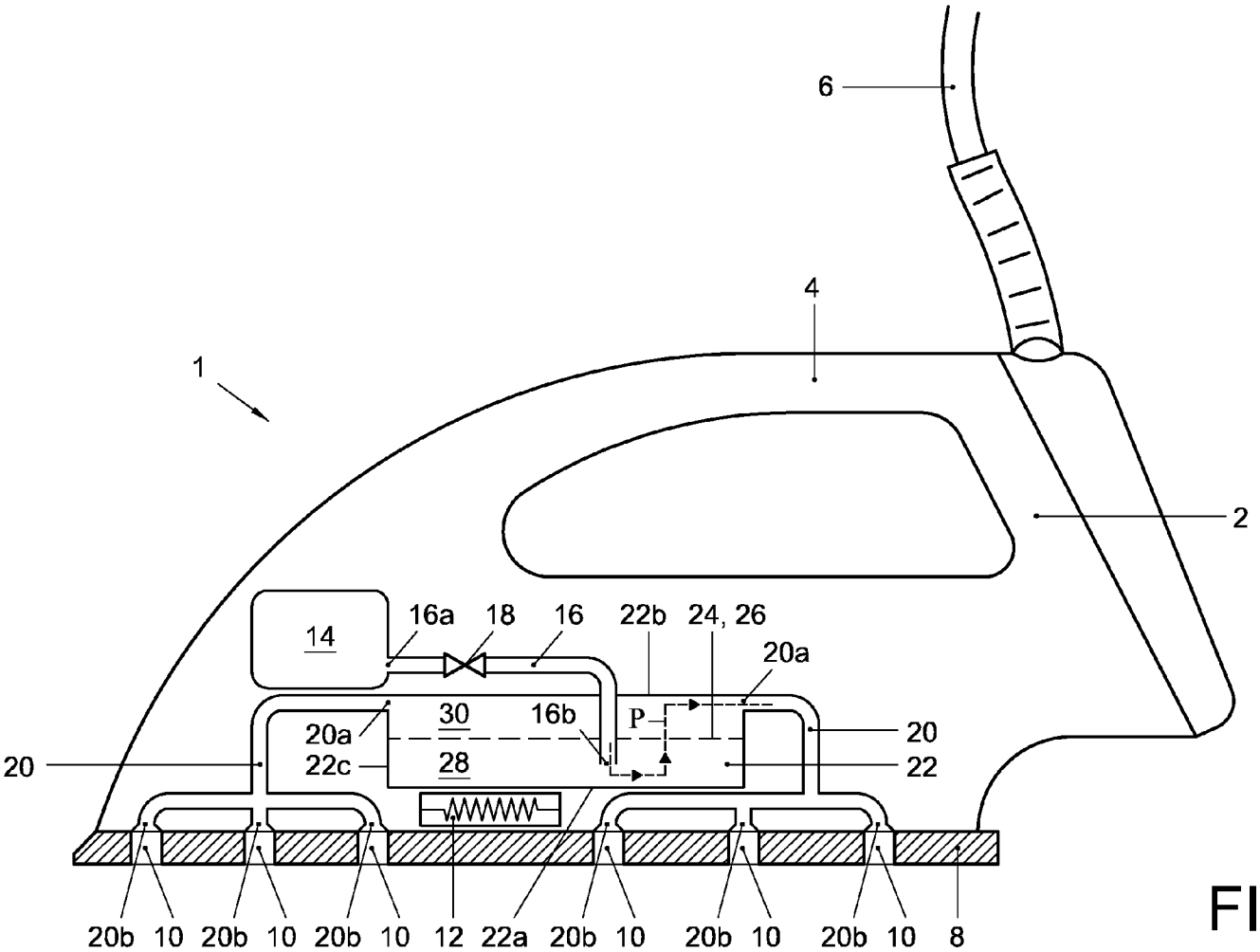
FIG. 1 is a schematic cross-sectional side view of a first exemplary embodiment of a steam iron according to the present invention.
Figure 2:
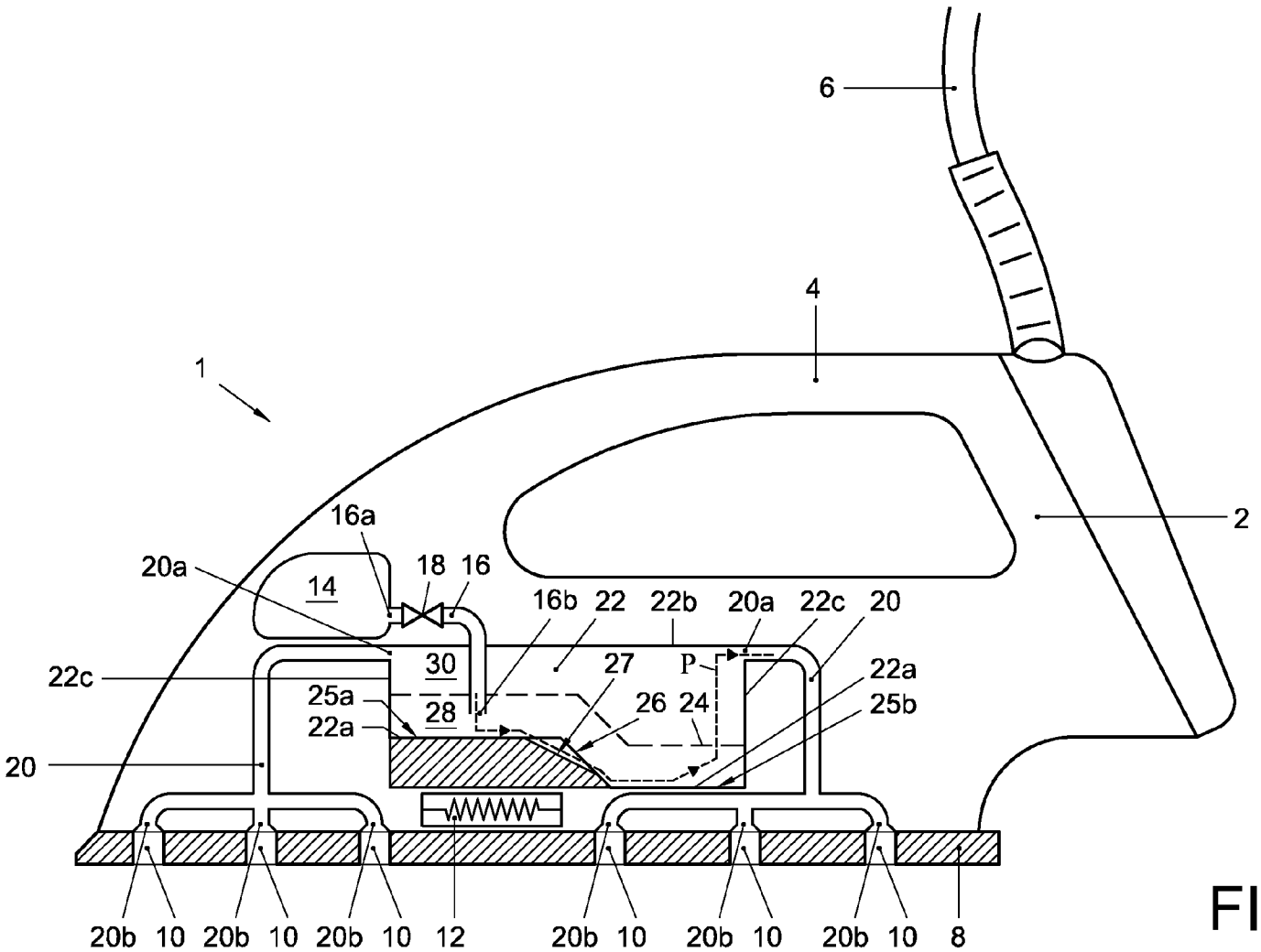
FIG. 2 is a schematic cross-sectional side view of a second exemplary embodiment of a steam iron according to the present invention.

FIGS. 1 and 2 schematically illustrate in cross-sectional side view two respective exemplary embodiments of a steam iron 1 according to the present invention. The steam iron 1 may be of a largely conventional design, and it will be appreciated that several components of the iron 1 which are well known and have no particular relevance to the present invention are omitted from the figures for reasons of clarity. Below, the construction and operation of the steam iron according to the present invention are discussed in general terms, where appropriate with reference to the embodiments depicted in FIGS. 1 and 2.

The steam iron 1 may comprise a housing 2 and a heatable soleplate 8 fixedly connected to a bottom side thereof. The housing 2 may define a handle 4 by means of which the iron 1 may be manually manipulated during use. The steam iron 1 may further include a power cord 6 that is connected to the housing 2 so as to enable any internal electrical components of the iron 1, most notably a heating element 12, to be powered through connection to the mains.

The housing 2 may define a water vaporization chamber 22. Although the water vaporization chamber 22 may in principle have any suitable shape, it may preferably be relatively compact and have a modest height in the range of 15-25 mm. At its lower side, the water vaporization chamber 22 may be bounded by a bottom wall 22*a*. In one embodiment the bottom wall 22*a* may be a simple, planar, soleplate-parallel wall. In another embodiment, the bottom wall 22*a* may include multiple wall sections defining soleplate-parallel plateaus that extend at different levels above the soleplate. Each two plateaus may be interconnected by an intermediate non-soleplate-parallel wall section, which may extend vertically or slope downwardly, such that liquid water may flow from a higher one of the two plateaus to a lower one of the two plateaus over said non-soleplate parallel wall section. In one embodiment, a non-soleplate-parallel may include a downward sloping open channel or gully (i.e. a channel having a downward sloping bottom surface). A bottom wall 22*a* having such height variations may promote the distribution of water throughout the vaporization chamber 22, and thus optimal use of its heated surface area. This is in particular true when liquid water is introduced therein at a relatively high level (e.g. by dripping the liquid water onto a relatively high portion of the bottom wall 22*a*), such that non-instantly vaporized liquid water can flow towards lower positions under the action of gravity.

In the embodiment of FIG. 1, the vaporization chamber 22 is bounded by a generally flat, soleplate-parallel bottom wall 22*a*, a bottom wall-parallel top wall 22*b*, and a circumferential side wall 22*c* that interconnects the bottom and top walls 22*a*, 22*b* and encircles the vaporization chamber 22. The vaporization chamber 22 of the second embodiment of FIG. 2 differs from that of the first embodiment of FIG. 1 in that the bottom wall 22*a* includes three wall sections 25*a*, 25*b*, 26. Two wall sections 25*a*, 25*b* define plateaus disposed at different levels above the soleplate 8: a higher plateau 25*a* and a lower plateau 25*b*. The two plateaus 25*a*, 25*b* are interconnected by a generally planar sloping wall section 26. As in the depicted embodiment, the sloping wall section 26 may be provided with an open channel or gully 27 having a downward sloping bottom surface, for guiding non-instantly vaporized liquid water from the higher plateau 25*a* to the lower plateau 25*b*, even before it can reach the edge between the higher plateau 25*a* and the plane of sloping wall section 26.

The vaporization chamber 22 may accommodate a steam-permeable screen 24. The steam-permeable screen may at least partially extend over the bottom wall 22*a* in a spaced apart relation thereto, so as to divide the vaporization chamber 22 into two volumes 28, 30. The two volumes may be referred to as the vaporization zone 28 and the steam zone 30, respectively, and their purposes may differ, as will be clarified below.

In one embodiment, the steam-permeable screen 24 may be fixed in the vaporization chamber 22 through attachment to the walls 22*a-c*. In the embodiment of FIG. 1, for instance, the substantially horizontal or soleplate-parallel steam-permeable screen 24 is fixed within the vaporization chamber 24 by circumferential attachment to the side wall 22*c* thereof. Alternatively, the generally soleplate-parallel steam-permeable screen 24 may be provided with one or more legs that extend downwardly therefrom, preferably perpendicular to the screen 24, and that support the screen 24 off the bottom wall 22*a* of the vaporization chamber 22. In one embodiment, a leg may conveniently be formed by a downwardly bent circumferential (flange-like) edge of the steam-permeable screen 24.

In both the embodiments of FIGS. 1-2, the volumes 28, 30 are distinct, and in fluid communication with each other exclusively via the steam-permeable screen 24. In another embodiment, the possibility of fluid communication between the volumes 28, 30 need not be limited to the screen 24. That is, alternative fluid communication routes that by-pass the screen 24 may exist between the volumes 28, 30, for instance in the form of gaps along the circumference of the screen 24, which gaps may be desired for design and/or manufacturing ease. It is understood, however, that such alternative routes may preferably be used only immediately adjacent regions of the vaporization zone 28 wherein liquid water accumulation and/or violent boiling of water is absent during use, so as to minimize the risk of water droplets passing from the vaporization zone 28 into the steam zone 30.

During operation, the vaporization zone 28 of the vaporization chamber 22 may serve to contain a pool or mass of liquid water to be evaporated. Accordingly, as in the illustrated embodiments, the vaporization zone 28 may preferably be at least partly bounded by the bottom wall 22*a* of the vaporization chamber 22, and be at least partially disposed below the steam zone 30. The heating element 12 may be disposed in thermally conductive contact with the portion of the bottom wall 22*a* bounding the vaporization zone 28, so as to enable the efficient supply of heat thereto for evaporating the water mass resting thereon during use. In a preferred embodiment, such as the embodiments of FIGS. 1-2, the heating element 12 may serve to heat both the bottom wall 22*a* of the vaporization chamber 22 and the soleplate 8 of the iron 1, although in other embodiments, different heating elements 12 may be provided to heat either of them.

The configuration of the vaporization chamber 22 may preferably allow the pool of liquid water to be contained within the vaporization zone 22 without it extending through the steam permeable screen 24 into the steam zone 30. As in the embodiments of FIGS. 1-2, this may be effected by having the steam-permeable screen 24 extend in between, and spaced apart from, the bottom and top walls 22*a,b* of the vaporization chamber, so as to divide the vaporization chamber into a lower vaporization zone 28, and an upper steam zone 30. The vaporization zone 28 may thus be naturally suited to contain a pool of liquid water.

During operation, the steam zone 30 may serve to receive steam from the vaporization zone 28, generated therein by vaporization of the liquid pool. The steam may be received through the steam-permeable screen 24, whose purpose may be to allow the passage of steam, and to prevent at least macroscopic liquid water droplets from passing through (stopping microscopic liquid water droplets at the screen 24 may be less critical to the prevention of spitting behavior of the steam iron 1, as the length and operational temperature of a steam path downstream of the screen 24 may typically be sufficient to warrant complete evaporation of such tiny droplets).

To this end, the steam-permeable screen 24 may define a plurality of openings, having an average size in the range of 0.2-5 mm, and preferably in the range of 1-2 mm. In one embodiment the steam-permeable screen may define a mesh having openings that are spread substantially uniformly across the totality of the area of steam-permeable screen 24. The mesh size may be about 2-50, and preferably 5-10, openings per linear centimeter of mesh. The shape of the openings, as seen when the screen 24 is laid out in a plane, may typically be square, diamond or regularly hexagonal (honeycomb), although other shapes may be employed as well.

The steam-permeable screen 24 may take various forms, e.g. a perforated sheet, an expanded sheet, a foamed material or a wire mesh, and be at least partly manufactured from a corrosion resistant metal, such as aluminum, an aluminum-alloy or stainless steel. Alternatively, the steam permeable-screen 24 may be at least partly manufactured from a ceramic material or from a heat-resistant polymer, e.g. an elastomer. Where it is desired for the screen 24 to capture both macro- and microscopic droplets, the mesh of the screen 24 may be interwoven or co-knit with yarn, e.g. fiberglass yarn.

Aside from the size of the openings in the steam-permeable screen 24, the average distance of the screen 24 to the surface of the liquid pool to be contained in the vaporization zone 28 is important. If the distance is too small, violent boiling of the pool may give rise to erupting surface jets that pierce the screen 24 and so deliver water droplets into the steam zone 30. If the distance is too large, the steam-permeable screen 24 may lose its function, and the water vaporization chamber 22 may become unnecessarily bulky. In a preferred embodiment, in which the steam zone 30 extends at least partly above the vaporization zone 28 (as in FIGS. 1-2), the steam-permeable screen 24 may preferably be disposed an average distance of at least 3 mm, and more preferably at least 5 mm, above the bottom wall 22*a* of the vaporization chamber 22, so as to allow the vaporization zone 28 to accommodate a shallow pool of water with a minimum depth of about 1-2 mm. An average maximum distance between the steam-permeable screen 24 and the bottom wall 22*a* may preferably be in the range of 3 to 15 mm. To effect a substantially uniform distance between the surface of a liquid pool and the steam-permeable screen 24, the screen 24 may preferably extend in parallel with, and optionally at a substantially constant distance from, the bottom wall 22*a* bounding the vaporization zone 28. In case the bottom wall includes downwardly sloping sections 26 and/or multiple soleplate-parallel plateaus 25*a*, 25*b*, such a bottom wall-parallel screen 24 is understood to essentially follow or track the height variations in the bottom wall, and thus to include corresponding sloping sections and/or plateaus. It is to be noted that the particular arrangement of the bottom wall 22*a* with plateaus 25*a*, 25*b* and/or sloping walls sections 26 enables the spreading of the water along the whole part of the bottom wall. This increases the contact surface and improves the vaporization. In a variant of the invention, this arrangement may be used without the steam-permeable screen 24.

At the upstream side of the vaporization chamber 22 the steam iron 1 may further include a liquid water reservoir 14, and a water supply channel 16 having a water inlet 16*a* that is fluidly connected to the water reservoir 14, and a water outlet 16*b* that discharges directly into the vaporization zone 28 of the vaporization chamber 22. A water outlet 16*b* discharging directly into the vaporization zone 28 may have a water outlet opening that is disposed in/defined by a bounding wall of the vaporization zone, or, as in the embodiments of FIGS. 1-2, itself protrude into the vaporization zone 28 and have a water outlet opening that is actually disposed inside of the vaporization zone. In embodiments featuring a vaporization chamber 22 with a bottom wall 22*a* that varies in height, such as the embodiment of FIG. 2, the water outlet 16*b* may preferably be arranged to discharge water onto a highest section/position 25*a* of the bottom wall 22*a*, or at least onto a section/position that is arranged higher than a lowest section/position 25*b* of the bottom wall. The water supply channel 16 may include a dosing valve 18 or other water metering means to enable adjustment of the flow rate at which water is supplied to the vaporization zone 28. It is understood that although the liquid water reservoir 14 may be accommodated by the housing 2, as shown in the embodiments of FIGS. 1-2, this need not necessarily be the case. Water may, for instance, alternatively be supplied through the water supply channel 16 from a water source that is disposed externally to the housing 2.

At the downstream side of the vaporization chamber 22, the steam iron 1 may include at least one steam discharge channel 20, having a steam inlet 20*a* that originates from the steam zone 30 of the vaporization chamber 22 and a steam outlet 20*b* that discharges into at least one steam outlet opening 10 provided in the iron's soleplate 8. A steam inlet 20*a* originating from the steam zone 30 may have a steam inlet opening that is disposed in a bounding wall of the steam zone, as in the embodiments of FIGS. 1-2, or protrude into the steam zone 30 from such a bounding wall and have a steam inlet opening that is actually disposed inside of the steam zone 30. Furthermore, the steam iron 1 may include multiple steam discharge channels 20, as shown in the embodiment of FIG. 1, each leading to one or more steam outlet openings 10 in the soleplate 8 of the iron 1, in order to enable a more efficient discharge of steam from the steam zone 30 at high steam rates.

Now that the construction of the steam iron 1 according to the present invention has been described in some detail, attention is invited to its operation.

During ironing, at least the portion of the bottom wall 22*a* of the vaporization chamber 22 bounding the vaporization zone 28 may be heated by the heating element 12 to a temperature well above the boiling point of water, e.g. 150° C. At the same time, liquid water may be supplied from the water reservoir 14 to the vaporization zone 28 via the water supply channel 16. The water may be supplied at a rate that enables the portion of the bottom wall 22*a* of the vaporization chamber 22 bounding the vaporization zone 28 to be inundated with a shallow pool of water, typically having a depth of about several millimeters. In case the bottom wall 22*a* of the vaporization chamber 22 includes height variations (see FIG. 2), these may help to distribute the water across the entire surface area of the bottom wall. Due to the temperature of the bottom wall 22*a*, the pool of water may boil violently. Its surface may surge irregularly and give rise to both loose water droplets and water jets that erupt in upward directions. Simultaneously, freshly generated steam may ascend from the surface. Both the liquid water droplets and jets and the steam may reach and impact upon the steam-permeable screen 24. As a result of the configuration of the screen 24, the liquid water droplets flying around in the vaporization zone 28 and the water jets may effectively break up as they hit the screen 24. The resulting smaller droplets may adhere to the screen 24, coalesce into larger droplets, and optionally flow out therein forming a thin liquid water film. Excess water on the screen 24 may flow or drip back into the liquid water pool under the action of gravity. Especially in a wetted, water film covered condition, the screen 24 may effectively limit the passage of liquid water particles. Steam, on the other hand, may force its way through the screen 24 even in wetted condition. Consequently, the steam-permeable screen 24 may ensure that only steam is admitted to the steam zone 30; i.e. only water-turned-into-steam may follow the flow path indicated P in FIGS. 1-2. From the steam zone 30, the steam may be discharged to the steam outlet openings 10 in the soleplate 8 of the iron 1 via the steam discharge channel 20. Since the steam flow from the steam zone 30 carries no liquid water particles, there may be no observable spitting at the steam outlet openings 10.

As regards the terminology employed in this text, the following is noted. The term "channel", as used in phrases like "liquid supply channel" and "steam discharge channel", may be construed to refer to any physical structure that defines a route of fluid communication, especially between an inlet and an outlet. Although the physical structure of a channel may generally be embodied by a conduit, a pipe, a tube, a duct, etc., the term channel is in itself not intended to imply any particular structural or geometrical qualities, such as, for instance, a hollow cilindrical shape.

Although illustrative embodiments of the present invention have been described above, in part with reference to the accompanying drawings, it is to be understood that the invention is not limited to these embodiments. Variations to the disclosed embodiments can be understood and effected by those skilled in the art in practicing the claimed invention, from a study of the drawings, the disclosure, and the appended claims. Reference throughout this specification to "one embodiment" or "an embodiment" means that a particular feature, structure or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, it is noted that particular features, structures, or characteristics of one or more embodiments may be combined in any suitable manner to form new, not explicitly described embodiments.

LIST OF ELEMENTS

1 steam iron
2 housing
4 handle
6 power cord
8 soleplate
10 steam outlet opening in soleplate
12 heating element
14 liquid water reservoir
16 liquid water supply channel
16*a,b* water inlet (a) and water outlet (b) of liquid water supply channel
18 dosing valve in liquid water supply channel
20 steam discharge channel
20*a,b* steam inlet (a) and steam outlet (b) of steam discharge channel
22 water vaporization chamber
22*a,b,c* bottom wall (a), top wall (b) and side wall (c) of water vaporization chamber
24 steam-permeable screen
25*a*, 25*b* higher (a) and lower (b) soleplate parallel section of bottom wall
26 sloping section of bottom wall

27 open water channel in sloping section of bottom wall
28 vaporization zone
30 steam zone
P water flow path

The invention claimed is:

1. A steam iron comprising:

a housing including a water vaporization chamber that is at least partly bounded by a bottom wall;

a heating element thermally coupled to the bottom wall for heating water delivered to the vaporization chamber;

a soleplate connected to the housing and defining at least one steam outlet opening;

a steam-permeable screen for selectively passing steam disposed within the water vaporization chamber such that it extends over the bottom wall in a spaced apart relationship thereto and divides the water vaporization chamber into a vaporization zone in which water is distributed and vaporized and a steam zone into which steam produced in the vaporization chamber passes through the steam-permeable screen;

a liquid water reservoir separate from the water vaporization chamber;

a liquid water supply channel having a water inlet that is connected to the water reservoir and a water outlet arranged for delivering liquid water from the reservoir specifically into the vaporization zone; and a steam discharge channel having a steam inlet coupled to the steam zone and a steam outlet coupled to the at least one steam outlet opening in the soleplate.

2. The steam iron according to claim 1 where the steam-permeable screen defines a plurality of openings having an average size in the range of 0.2-5 mm.

3. The steam iron according to claim 1 where the steam-permeable screen defines a mesh, having 2-50 openings per linear centimeter of mesh.

4. The steam iron according to claim 3 where the steam permeable screen defines a mesh, having 5-10 openings per linear centimeter of mesh.

5. The steam iron according to claim 1 where the steam-permeable screen is at least partly made of at least one of aluminum, an aluminum alloy, and stainless steel.

6. The steam iron according to claim 1 where the steam permeable screen is at least partly made of at least one of a ceramic material and a high-temperature polymer.

7. The steam iron according to claim 1 comprising a plurality of steam discharge channels and a plurality of steam outlet openings in the soleplate, where each steam discharge channel has a steam inlet that originates from the steam zone and a steam outlet that discharges into at least one steam outlet opening.

8. The steam iron according to claim 1 where the vaporization zone and the steam zone are in fluid communication exclusively via the steam-permeable screen.

9. The steam iron according to claim 1 where the vaporization zone is adapted to contain a pool of liquid water.

10. The steam iron according to claim 1 where an average distance between the steam-permeable screen and the bottom wall of the vaporization chamber is at least 3 mm.

11. The steam iron according to claim 1 where an average distance between the steam-permeable screen and the bottom wall of the vaporization chamber is in the range of 3-15 mm.

12. The steam iron according to claim 1 where the bottom wall of the vaporization chamber includes two wall sections that define soleplate-parallel plateaus disposed at mutually different levels above the soleplate, and a non-soleplate-parallel wall section that interconnects said two plateaus, such that liquid water may flow from a higher one of the two plateaus to a lower one of the two plateaus over said non-soleplate parallel wall section.

13. The steam iron according to claim 12 where the non-soleplate parallel wall section includes a generally planar surface provided with a downward sloping open channel configured to guide water from the higher one of the plateaus to a lower one of the two plateaus.

14. The steam iron according to claim 12 where the water outlet is arranged to discharge liquid water onto a position of the bottom wall that is higher than a lowest position of the bottom wall.

15. The steam iron according to claim 1 where the steam-permeable screen extends substantially in parallel with the bottom wall of the vaporization chamber.

16. The steam iron according to claim 1 where the liquid water supply channel includes a controllable valve for adjusting a flow rate at which liquid water is supplied to the vaporization zone.

* * * * *